United States Patent [19]

Whitcomb et al.

[11] Patent Number: 4,808,565

[45] Date of Patent: Feb. 28, 1989

[54] THERMAL IMAGING MATERIAL

[75] Inventors: David R. Whitcomb, Maplewood; Jon A. Bjork, Cottage Grove, both of Minn.

[73] Assignee: Minnesota Mining and Manufacturing Company, St. Paul, Minn.

[21] Appl. No.: 73,889

[22] Filed: Jul. 7, 1987

Related U.S. Application Data

[63] Continuation-in-part of Ser. No. 896,765, Aug. 14, 1986, abandoned.

[51] Int. Cl.[4] ..... B41M 5/18

[52] U.S. Cl. ..... 503/211; 106/21; 427/150; 427/151; 428/913; 428/914; 503/214; 503/216; 503/217; 503/225

[58] Field of Search ..... 106/21; 427/150–152; 503/211, 216, 217, 225, 214; 428/913, 914

[56] References Cited

U.S. PATENT DOCUMENTS

| | | | |
|---|---|---|---|
| 2,663,654 | 12/1953 | Miller et al. | 117/36 |
| 3,094,620 | 6/1963 | Reitter | 250/65 |
| 3,111,423 | 11/1963 | Ostlie | 117/36.8 |
| 3,293,055 | 12/1966 | Baum | 106/171 |
| 3,442,682 | 5/1969 | Fukawa | 117/36.8 |
| 3,483,143 | 12/1969 | King et al. | 260/2 |
| 3,829,401 | 8/1974 | Futaki et al. | 260/38 |
| 3,846,153 | 11/1974 | Futaki et al. | 117/36.9 |
| 3,953,659 | 4/1976 | Truitt | 428/511 |
| 4,049,612 | 9/1977 | Sandler | 260/31.8 R |
| 4,531,144 | 7/1985 | Sagawa | 346/209 |
| 4,533,930 | 8/1985 | Shioi et al. | 346/211 |
| 4,602,264 | 7/1986 | Shioi et al. | 346/216 |
| 4,631,084 | 12/1986 | Sagawa | 346/211 |

FOREIGN PATENT DOCUMENTS

| | | |
|---|---|---|
| 2109025 | 6/1974 | United Kingdom . |
| 2130614 | 7/1976 | United Kingdom . |

OTHER PUBLICATIONS

Smythe et al., *J. Inorg. Nucl. Chem.*, 1968, vol. 30, pp. 1553–1561, "The Infra-Red Spectra of Complexes of Beryllium with Tri-n-octylphosphine Oxide and Di(2--ethylhexyl) Phosphoric Acid".

Anderson et al., "Development of Iron Chelators for Clinical Use", Symposium, Sep. 22, 1975, U.S. Department of Health, Education and Welfare.

Crofts et al., *J. Am. Chem. Soc.*, 1958, 74, 2995–2997, "Unsymmetrical Dialkylphosphinic Acids".

*J. Inorg. Nucl. Chem.*, 1967, vol. 27, pp. 697–709, "Variation of the $pK_A$ of (X) (Y) PO(OH) with X and Y in 75 and 95 Per Cent Ethanol", D. F. Peppard, G. W. Mason and C. M. Andrejasich.

*J. Am. Chem. Soc.*, 1985, 107, 4094–4095, "High Dilution Synthesis of Macrocyclic Polycatecholates", Steven J. Rodgers, Chiu Yuen Ng and Kenneth N. Raymond.

*J. Am. Chem. Soc.*, 1934, pp. 1934, pp. 1678–1681, "The Condensation of Catechol with Acetone", Wilson Baker.

*Primary Examiner*—Bruce H. Hess

*Attorney, Agent, or Firm*—Donald M. Sell; Mark A. Litman

[57] ABSTRACT

Thermographic materials are colorless when unexposed, but provide an intense dark image when thermally addressed. The materials comprise white ferric organophosphate, ferric organophosphinate, or ferric organophosphonate in a clear binder with a colorless catechol or polycatechol held in said binder in solid solution. The choice of substituents on the catechol nucleus can give a change in the color of the thermal image together and provide good near infrared absorption. Use of mixed catechols can give achromatic black images. These combinations of materials show high stability at ambient temperatures.

20 Claims, No Drawings

THERMAL IMAGING MATERIAL

This is a continuation-in-part of application Ser. No. 896,765 filed Aug. 14, 1986 now abandoned.

BACKGROUND OF THE INVENTION

1. Field of the Invention

This invention relates to thermographic materials. More particularly it relates to substantially colorless thermographic layers on a substrate. Many existing compositions exhibit a yellow or brown color cast which is caused by colored thermally sensitive metal compounds such as iron stearate. This invention uses compositions containing colorless iron salts which are thermally reactable to give a visible image.

In commercial applications, thermally developed labels are sought which not only provide visible images but which are also capable of being read by optical scanners using near infrared radiation (NIR). The images resulting from catechols with certain substituents exhibit low discrimination in the NIR. Other catechols give good discrimination both visually and to NIR.

2. Background of the Art

For many years heat-sensitive imaging sheets have been used for copying, thermal printing, thermal recording, and thermal labeling. Many of these materials involve thermally increasing the reactivity of two or more components of a color forming reaction which do not react at normal ambient temperatures. Reactivity is often enhanced by melting of one or both reactants which are physically separated from one anoher. Separation is accomplished either by dispersion in a single coated layer or by being situated in two different coated layers. Several general classes of color forming reactants have been used, of which two common ones are (a) leuco lactone or spiropyran compounds reactable with phenolic compounds (e.g. U.S. Pat. Nos. 3,829,401 and 3,846,153) and (b) heavy metal salts of organic acids reactable with ligands to give colored complexes (e.g. U.S. Pat. Nos. 2,663,654, 3,094,620, 3,293,055 and 3,953,659).

Commercial preference for the heavy metal salt class has often resulted from the high stability and near black color of the images produced (U.S. Pat. No. 4,531,141). Of the heavy metals used, iron, nickel, and cobalt are common and ferric iron appears to be preferred (U.S. Pat. Nos. 2,663,654, 3,953,659 and 4,531,141).

Two objections raised to the ferric salt-phenolic ligand systems are the colored nature of the unreacted ferric salt and the background stain often experienced because of the insidious, slow reaction of the two reactants on storage or during coating. Indeed, if the reactants are intimately mixed they often react rapidly at room temperature (U.S. Pat. Nos. 3,442,682, 4,531,141). The first objection has led to the use of white fillers (U.S. Pat. No. 4,531,141) or other incident light scattering devices (e.g., "blushing" the surface of the layer as in U.S. Pat. No. 3,953,659) to reduce the observed color tint of the coated layer. The second objection has led to the use of stabilizing compounds added to the reactive layer (U.S. Pat. Nos. 2,663,654, 3,442,682) and more particularly to the physical separation of the two reactants (U.S. Pat. No. 4,531,141) either by dispersion as separate micro-particles (U.S. Pat. Nos. 2,663,654, 3,094,620, 3,111,423, and 3,293,055) or by separating the reactants in distinct but adjacent layers (U.S. Pat. Nos. 3,111,423 and 3,442,682).

As indicated earlier, a considerable list of heavy metals has been used in their organic acid salt form to give thermographic images (U.S. Pat. Nos. 3,111,423 and 3,293,055). Some heavy metals giving colorless salts have been used and will be found amongst those listed in these two references. Such heavy metals (e.g., zinc), however, must be reacted with ligands which themselves contribute color to the image and may indeed have a color cast before reaction. These heavy metals have not successfully provided satisfactory thermographic materials which are truly colorless and also give a deep near black color on thermal exposure.

Thus the art discussed so far shows consistent interest in two problems of ferric chelate imaging (a) the colored nature of ferric organic acid salts and (b) the difficulty in controlling the room temperature reactivity of such salts with the range of ligands available.

More recently there has been interest evinced in obtaining thermographically reactive iron salts which are colorless and which give sharp, high density images when reacted with a colorless ligand. Organo-phosphates of ferric iron are known in the art to be amongst the few colorless ferric salts (Smythe et al., J. Inorg. Nucl. Chem., 30 1553–1561, (1968)). In U.S. Pat. No. 4,533,930 it is disclosed that such organophosphates and the equivalent thiophosphates can react with a variety of ligands under the influence of heat to give colored results. Ferric salts of organophosphinic acid and organophosphonic acids are included. Some of these organophosphates and many of the thiophosphates have some color cast before reaction which appears to be obscured by the use of white filler in the thermosensitive compositions. In the thermographic materials disclosed, the reaction of the ferric salt with the ligand at ambient temperatures is precluded by either dispersing each reactant in microparticulate form in the binder or by providing separate but adjacent layers for the two reactants. These conditions are explicitly identified in the claims by the wording "said metal compound and said ligand compound being physically separated from one another . . . ". Also in this patent there are disclosed pressure-sensitive manifold papers in which at least one of the two reactants is encapsulated as a solvent solution. When the microcapsules are burst by pressure, the reactants come in contact and immediately react at room temperature to give a colored result. This patent further discloses the use of ferric organophosphates containing organic acid moieties as formed by the aqueous reaction of a ferric salt, an alkali metal organophosphate, and an alkali metal salt of an organic acid. These are disclosed as giving the initial material better "color forming properties" and giving better image colors (Column 5 lines 38–39) than the simple organophosphates. Excess organic acid salt is disclosed as degrading the white color. It is of significance that the inventors do not consider the choice of the ferric salt used in the preparation to be important. In fact they specifically mention ferric chloride and ferric sulfate (Column 6 lines 10–17) and all of their examples use ferric chloride.

SUMMARY OF THE INVENTION

This invention provides thermographic layers which are colorless when unexposed and are stable at room temperatures but give intense dark colors when exposed to elevated temperatures.

These layers comprise a transparent binder, and at least two thermal reactants which react with one another at elevated temperatures; one of these reactants is in solid solution in the binder, the other is dispersed in microparticulate form in the binder. Despite intimate contact between the two reactants, no reaction occurs until the temperature is elevated well above room temperature.

The microparticulate reactant is chosen from a class of ferric iron complexes in which the ligand is chosen from organophosphates, organophosphinates, and organophosphonates which are colorless and which react with the second reactant only at elevated temperature. The second reactant is chosen from the class of catechols including polycatechols characterized by being colorless. Bis-catechols are particularly preferred.

The thermographic layers are coated or extruded from coating mixes using non-aqueous solvents, which solvents enable efficient milling of the ferric organophosphates, and provide a solution mixture of the binder and the catechol.

A principal aspect of the invention is to provide colorless thermographic sheets which give dark colored images when addressed with elevated temperatures.

An aspect of the invention is to provide colorless thermographic sheets which are stable at room temperatures.

A further aspect of the invention is to provide colorless thermographic materials which are stable during the process of coating and drying layers on a substrate.

Yet another aspect of the invention is to provide colorless thermographic sheets which give thermal images exhibiting good discrimination when examined with near infrared radiation (NIR).

Still another aspect of the invention is to provide colorless thermographic sheets which give black thermal images exhibiting good visual discrimination and also good NIR discrimination.

Iron(III) is the preferred metal for the thermal reaction with catechol since it is capable of oxidizing the catechol and generating iron complexes that are both black in the visible and strongly absorbing in the near infrared. Definitions:

"polycatechol" molecules containing more than one o-dihydroxybenzene moiety, the moieties being connected by an organic connecting link which does not provide electronic interaction between the moieties, such as a saturated organic group (e.g., alkyl, cycloalkyl). This group includes biscatechols.

"ferric organophosphate" compounds of the form $$Fe(O_2P(OR)_2)_3$$

where R is an organic moiety such as alkyl, aryl, alphyl, alicyclic groups, etc.

"ferric alkylphosphate" as above where R is an alkyl moiety.

"chelate" in this case refers to the catechol and is normally bidentate but may be polydentate.

DETAILED DESCRIPTION OF THE INVENTION

U.S. Pat. No. 4,533,930 discloses a wide range of ferric salts of organo phosphorus oxyacids and thioacids as useful in thermographic reactions with a range of ligands. They are presented as giving much whiter backgrounds than ferric salts previously used in this art. It is clear from the examples and confirmed from our own investigations that the organothiophosphates are highly colored and dark. Furthermore, a great many of their examples using organophosphates record appreciable coloration of the compounds and whiteness levels are achieved by the use of fillers such as zinc oxide, aluminum hydroxide, and calcium carbonate.

This invention defines a preferred narrow range of ferric organophosphates which are entirely colorless, some of which are encompassed by the disclosure of U.S. Pat. No. 4,533,930 (I) whereas others are not (II). These compounds are di-alkylphosphates and have structures chosen from the general formulae $$Fe[OOP(OR)_2]_3 \quad (I)$$

and $$Fe[OOP(OR)_2]_3.X \quad (II)$$

in which each R is selected independently from alkyl groups and substituted alkyl bearing substituents such as those selected from alkyl, cycloalkyl, and aryl providing that such substituents do not act as ligands or chelates for ferric ions.

Preferably R is selected from the group represented by the formula $$-(CH_2)_a-\underset{}{\overset{(CH_2)_c-H}{\overset{|}{CH}}}-(CH_2)_b-H$$

where b>a, b>c, c is 1 to 10, and 3<=a+b<=18, and

X is selected from $F^-$, $PF_6^-$, $Ph_4B^-$, $BF_4^-$, $CH_3COO^-$, and $C_2H_5COO^-$, $C_{14}H_{29}SO_4^-$ (where Ph=phenyl)

Our preferred compound is in formula I with a=2, b=4, and c=2.

Previously used iron carboxylates typically are too highly colored and cannot produce colorless backgrounds. Dialkylphosphates are the preferred ligand for iron(III) since the resulting complexes are completely colorless. Mixed dialkylphosphate/carboxylate iron complexes can be made to be less colored than iron carboxylates, but they still retain undesirable color because of the presence of the carboxylate. The iron complexes of the sulfur analogues of the carboxylates, phosphates, and their mixtures are particularly undesirable since they are highly colored, even black, materials.

If trialkylphosphates are used as the main ligand, sufficiently stable iron complexes do not form, and if monoalkylphosphates (as well as inorganic phosphates) are used, generally undesirable, extensive crosslinking occurs between metal centers such that the resulting iron organophosphate is too stable to react with the catechol. Aromatic phosphates often provide an iron complex that is high melting, less reactive and more colored than the dialkylphosphates.

The most preferred organophosphate ligands are branched chain dialkylphosphates, and especially di-2-ethylhexylphosphate (DEHP). Linear chain dialkylphosphates form colorless iron complexes that give images with catechols but are generally too unreactive (too highly crosslinked) to provide sufficient image density. The branch on the main chain should be sufficiently long and sufficiently close to the metal center that crosslinking between metal centers is inhibited. On the other hand, the branch should not be too long or too close to the phosphorus center since iron that is incompletely reacted with the phosphate may result in a colored iron source, and would probably be too reactive in the coating solution. From a practical aspect, the ideal structure is illustrated by DEHP. The range for the side chain length might be best put at about 1–10, the further from the connection point to the phosphorous the longer the chain. The length of the main chain is best illustrated by DEHP, that is, around 6–10. Chains as long as 18 are the practical maximum due to the required loading necessary to achieve suitable optical density (i.e., molecular weight becomes impractically high). Asymmetric dialkylphosphates provide lower melting iron complexes.

Alkyl phosphinic acids (in which the alkyl groups are attached directly to the phosphorus) show good thermal reactivity with the catechols but are not preferred over the alkylphosphates. Apparently the higher pKa (insufficiently acidic) prevents them from forming a truly colorless, oligomeric complex. Ferric propyl(2-ethylhexyl)phosphinate, ferric cyclohexyl(2-ethylhexyl)phosphinate, and ferric dicyclohexylphosphinate have been made and found to be thermally reactive with catechols. Dialkyl-phosphonic acids (one R group attached directly to the phosphorus, the other attached via oxygen) have pKa's in between dialkylphosphates and dialkylphosphinic acids but have not been shown to be useful. DEHP not only works well, it is commercially available in large quantities of relatively good purity.

$Fe(DEHP)_3$ is preferred in the iron organophosphate series. It is completely colorless, a major improvement over the iron carboxylates and mixed carboxylate/organophosphate iron complexes. In addition, unlike the general straight chain dialkylphosphate iron complexes, it is very thermally reactive with the bis-catechols. It is also insoluble in the organic solvents required to coat this type of thermal imaging construction, unlike mixed carboxylate/organophosphate iron complexes.

The chelate compounds which we select as thermal reactants with these iron compounds, are chosen to be colorless, to be non-reactive with the iron compounds at room temperatures even on intimate contact, to be rapidly reactive at elevated temperatures above about 60° C., and to be easily soluble in organic solvents which are also solvents for the binder used. In this invention these chelates are preferably chosen from polycatechols and heavily ballasted monocatechols.

Common catechols are too reactive to be used with the preferred iron source in the preferred construction. Polyhydroxy catechols are similarly too reactive to be preferred.

The preferred catechols are those in which two catechol (specifically o-dihydroxybenzene) groups are part of the same molecule but in which the connecting group insures minimum electronic interaction between the catechol rings. They should not therefore be parts of the same aromatic ring system. The preferred connection between catechols is alkylidene. Aromatic linkage would provide such electronic interaction between catechol groups that they would be too reactive. Aromatic linkages also give compounds which are colored and thus are precluded by the requirement that the chelate be colorless. Fused ring connections, as illustrated by the preferred catechol, are excellent. Preparation of this compound, 1,1'- spirobi[-1H-indene]-5,5'-6,6-tetrol-2,2'3,3',-tetrahydro-3.3. 3,3'-tetramethyl, is known in the art. Heteroatomic fused ring connections are also acceptable. These are illustrated in Formula III.

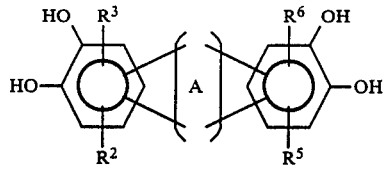

III where A is a saturated ring system optionally containing hetero atoms such as N, O, S, and $R^2$, $R^3$, $R^5$ and $R^6$ are independently chosen from forms which together alter the electronic character (donating or accepting) of the OH groups on the ring. Such groups include, but are not limited to H; halogen (F, Cl, Br, and I); groups with no more than 10 atoms in the backbone structure selected from C, N, S and O, (which may of course be further substituted by additional groups such as halogen); and aliphatic groups of up to 20 carbon atoms (e.g., alkyl, ethers, thioethers, etc.) The heterogroups with up to 10 carbon atoms includes heterocyclic and aromatic groups as well as linear and branched groups. Preferably these groups do not provide an acid hydrogen. Preferably the groups are not chosen from substituents comprising an acidic hydrogen linked to the aromatic ring through a single atom chosen from O, S, and N, and The two catechol units need not be symmetrical in their substituents or their positioning.

The position of the o-hydroxy chelate site relative to the connection site between the two catechol groups is not critical. Substituents such as —OH, —SH, and —$NH_2$ which contain acidic hydrogen can produce high reactivity of the o-dihydroxy substituents and are therefore not preferred in this invention.

Molecules containing more than two catechol groups are also acceptable, as long as the connecting linkage between the catechols meets the above requirements. Thus in formulae IV, and V oligomers or polymers are illustrated which are useful chelates in this invention

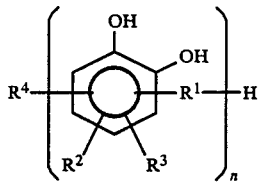

IV where $R^2$, $R^3$ are as defined above $R^4$ is a capping substituent preferably —H or alkyl $R^1$ is a bivalent linking group preferably alkylene, or a chain which may contain N, S, O, but may be phenylene, naphthylene or combinations of these with the proviso that $R^1$ does not facilitate electronic interaction between the catechol moieties, and n is an integer of 2 or more.

V

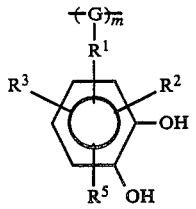

where $R^2$, $R^3$, and $R^5$ are defined above,

G is a unit in a polymer chain chosen from hydrocarbons, alkyd, acryloid, polyester, phenol formaldehyde resins etc. which are miscible with the binder used, and m is an integer of 3 or more, $R^1$ is either as defined above, or if G does not facilitate electronic interaction between catechol moieties, then $R^1$ need not be restricted in this way and in addition to the definition above may be chosen from a single bond and the groups defined for $R^2$, $R^3$ and $R^5$ above Monocatechols are in general too reactive for use in this invention but if the ring is sufficiently ballasted with a non-reactive ballasting group such catechols can be used. Formula VI represents such ballasted monocatechols useful in this invention.

VI

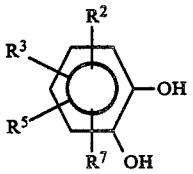

where $R^2$, $R^3$ and $R^5$ are defined above and $R^7$ is an alkyl chain of eight or more carbon atoms.

The substituent groups $R^2$, $R^3$, $R^4$, $R^5$, and $R^6$ may serve three functions: (a) sterically constrain the molecule to enhance or inhibit interactions between the reacted metal centers, (b) modify the solubility and melting point of the catechol, and (c) modify the electronic character of the hydroxy groups by withdrawing or donating electron density to the chelating site.

One of the most important functions of the R group is the control of the electronic properties of the catechol, in order to control the color of the final image. Commonly known electron donating R groups (such as alkyl, mono- or di-alkyl substituted amino, alkoxy, etc.) enable the catechol to be oxidized more readily by the iron, which is important for obtaining the infrared absorption properties (at 905 nm in particular) needed for bar code readers. A green complex results upon imaging this material with iron. Conversely, commonly known electron withdrawing R groups (such as nitro, ammonium, halogen, etc.) inhibit oxidation of the catechol by the iron. The resulting complex will tend to remain a violet-blue. The combination of catechols containing both electron donating and electron withdrawing groups provides for an imaging construction that is able to generate both a desirable black visible image and a high contrast image in the near infrared. The connecting linkage between the catechol groups may be used to control all three functions, (a)–(c), if the R groups are built into the connecting linkage.

The proper choice of the substituents on each catechol in the bis-catechol or polycatechol molecule can give the desired mixture of visible and NIR absorption properties. Alternatively the physical mixture of catechols with the different substituents can give similar results.

A number of bis-catechols are available commercially e.g., nordihydroguaiaretic acid.

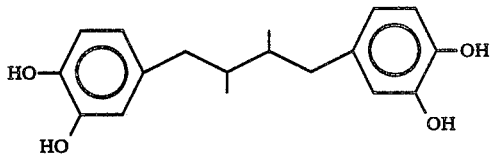

Preparation of polycatechols is disclosed in Rodgers et al. J. A. C. S., 107, 4094 (1985) and in Anderson & Hiller, "Development of Iron Chelators for Clinical Use" DHEW Publ. No. (NIH) 76–994 p. 137. These polycatechols may be represented by the formula:

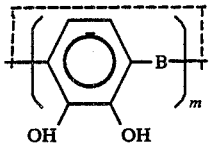

wherein B comprises the atoms in an organic bridging group necessary to complete a cyclic structure with the included catechol moiety or moieties and m is 1 to 10, preferably 1 to 4. B is preferably comprised of C and N ring atoms and is more preferably selected from

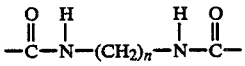

wherein n is 1 to 20, preferably 1 to 4. Rodgers et al., supra, shows the formation of monomers, dimers, trimers, tetramers, pentamers, and hexamers having these diaminoalkine linkages.

Of particular importance to this invention is that the chelate and the binder are soluble in a common solvent and that after coating and drying off the solvent the chelate remains in solid solution in the binder. The ferric alkylphosphates are not soluble either in the solvent or in the binder and are thus dispersed in the latter as microparticles which are in intimate contact with the chelate in solid solution. These two reactants exhibit very poor reactivity even at elevated temperatures if they are physically separated in the binder by using dispersed microparticles of the chelate as well as the ferric alkylphosphate. In the practice of this invention these classes of chelate exhibit very low reactivity at room temperature but good reactivity at elevated temperatures.

Binders suitable in this invention are polyacrylate and methacrylate and their copolymers vinyl resins, styrene resins, cellulose resins, polyester resins, urethanes, alkyl resins, silicones, and epoxy resins. Generally the resins must be miscible with non-aqueous solvents and have a melting point above the reaction temperature of the ferric compound and chelate. The binder should also be transparent.

A coating composition suitable to make a thermal recording sheet can be made in the following manner.

The ferric alkylphosphate (I or II) is dispersed in a solvent such as acetone, methyl ethyl ketone, ethanol, etc., by ball milling. To this dispersion a polymer binder and a chelate (III, IV V or VI) both soluble in the chosen solvent are added and agitated until dissolved. The coating composition may then be coated on a suitable substrate and dried at temperatures below thermal reaction temperatures.

Substrates which may be used are films of transparent, opalescent, or opaque polymers, paper, optionally with white or colored surface coatings, glass, ceramic, etc. The substrate must be stable and undistorted at the thermal reaction temperatures which are preferably between 60° and 200° C. and more preferably between 80° and 150° C.

We have found that the preparation of the colorless ferric organophosphate compounds I is not as simple as U.S. Pat. No. 4,533,930 suggests. Their method involves mixing aqueous solutions of an alkali metal salt of the organophosphoric acid and a ferric salt of a strong mineral acid such as hydrochloric and sulfuric, which results in a precipitate of the ferric organophosphate. It has been found that ferric chloride which is preferred by the patent gives slightly colored precipitate even with alkyl phosphates whereas those from ferric nitrate are completely colorless. The preferred preparation therefore uses ferric nitrate to give compounds I and II.

Ferric alkylphosphate compounds II where

X=fluoride, hexafluorophosphate, tetraphenylborate, tetrafluoroborate, tetradecylsulfate, acetate, and propionate.

This may be prepared by mixing required equivalent quantities in aqueous solution of ferric nitrate, alkali metal salt of the alkylphosphoric acid, and the alkali metal salt of the acid HX. Compound II then precipitates.

When X=acetate, however, the acetate ion is too soluble in water to remain attached to the ferric alkylphosphate and the result is the compound I again. However, if the ferric nitrate and alkali metal alkylphosphate are dissolved in glacial acetic acid, then compound II for X= acetate is precipitated. This compound and the fluoride may also be prepared using ethyl alcohol as solvent and adding potassium acetate or sodium fluoride to the ferric nitrate and alkali metal phosphate in required equivalent amounts.

It is of interest to note that the disclosure of U.S. Pat. No. 4,533,930 says that any carboxylic or thiocarboxylic acid may be used to form "composite iron salt" by reacting ferric chloride, an organic phosphoric acid and the carboxylic acid in an aqueous medium. The patent says that non-white salts are precipitated if the carboxylic acid is in excess. Their preferred carboxylic acids contain 5 or more carbon atoms. Our experimental evidence is that the composite iron salts obtained by their methods are of the form (leaving thio equivalents aside)

$$Fe(OOPR'_2)_y(OOCR)_x$$

where y+x=3 and R, R' can be a wide range of aliphatic and aromatic substituents. $R=CH_3$ cannot be obtained by their preparation.

The following are preparative examples for the ferric alkylphosphates I and II.

EXAMPLE A

Preparation of $Fe(DEHP)_3$

1. The method is similar to (but using ferric nitrate instead of ferric sulfate) the literature preparation of L. E. Smythe, T. L. Whateley and R. L. Werner (J Inorg. Nucl. Chem., 30, 1553 (1968)). To 2.0 g KOH in 175.0 ml $H_2O$ is added 10.0 g DEHP. This solution is added over 5 minutes to 35.0 ml of water containing 4.0 g $Fe(NO_3)_3.9H_2O$ with vigorous stirring. The mixture is stirred 10 minutes, filtered, washed in fresh water with stirring, filtered and dried under vacuum at 70° C. to a constant weight. An-off white solid is obtained . The infrared spectrum shows the expected phosphate stretches, as well as small amounts of OH, and the characteristic ethyl group presence at 1466.1 $cm^{-1}$. The Differential Scanning Calorimeter (DSC) revealed a melting point endotherm of this complex at 120° C.

2. To 1.0 liters of water is added 16.8 g KOH. To a separate 1.5 liters of water is dissolved 11.0 g $NaBF_4$, then 38.2 g $Fe(NO_3)_3.9H_2O$. While the iron salt is dissolving, 97.7 g DEHP is added to the rapidly stirred KOH solution The thick phosphate solution is added rapidly to the iron solution with mechanical stirring. The pure white, rubbery solid is filtered, washed with stirring, filtered and dried. It is important that the source of iron(III) is not ferric chloride as it gives a yellow product. DSC shows a melting point endotherm of the material at 145° C. The infrared spectrum of a vacuum dried (room temperature) sample reveals the expected phosphate stretches, but unlike 1 (above) there is no presence of OH.

3. Example Al may also be carried out at elevated temperatures (60° C.) with no disadvantageous effects. The same endotherm behaviour in the DSC is obtained as in Al.

EXAMPLE B

Preparation of $Fe(DEHP)_3$(acetate)

Powdered $Fe(NO_3)_3.9H_2O$, 80.8 g, is dissolved in 800 ml glacial acetic acid. As soon as a clear solution is obtained, 193.0 g bis-(2-ethylhexyl)phosphate (DEHP) is added in a rapid dropwise manner with vigorous stirring. Less than a stoichiometric amount of DEHP gives a more colored product; an excess of DEHP is not disadvantageous. The white product is filtered, washed with acetic acid and dried under vacuum. The approximate yield is 84%. The product is found to be rubbery and may be recrystallized by precipitation from cyclohexane by acetone. It is important that $FeCl_3$ not be used since a clear yellow acetic acid solution results.

Alternative preparation from ethanol: To 40 ml of absolute ethanol is added 2.0 g $Fe(NO_3)_3.9H_2O$. Upon dissolution, 5.0 g DEHP are added, and the clear solution stirred 5 minutes. An aqueous solution of potassium acetate (0.5 g in 4.5 g $H_2O$) is added dropwise. The mixture is stirred 2 minutes, filtered, redispersed in water, stirred an additional 20 minutes, filtered and vacuum dried. The infrared spectrum is identical to that prepared from acetic acid.

Characterization: The infrared spectrum clearly shows the coordinated organophosphate (1000–1200 cm−1) and carboxylate (1551.0 cm−1 asymmetric stretch, the symmetric stretch is under other peaks), and the absence of Fe-O-Fe stretches. DSC shows a small exotherm centered around 215° C. followed by the main endotherm centered at 282° C. The complex is readily soluble in cyclohexane, and is an excellent film forming material when coated on a substrate (clear, colorless film). Elemental analysis is consistent with the presence of one carboxylate, and confirms the 3:1 P:Fe ratio. Magnetic susceptibility determined by the Evan's NMR method (J. Chem. Soc., 2003 (1959), demonstrates a high spin iron complex. The complex was also found to be conductive in cyclohexane solution.

EXAMPLE C

Preparation of $Fe(DEHP)_3F$

1. To 500.0 g $H_2O$ is added 6.0 g KOH. To a separate 500.0 g $H_2O$ is added 12.0 g $Fe(NO_3)_3.9H_2O$ followed by 0.62 g NaF. To the aqueous base solution is added 32.0 g DEHP, which is then added rapidly to the mechanically stirred iron solution. The pure white iron complex is filtered, washed and vacuum dried.

2. To 300 ml ethanol is added 16.13 g $Fe(NO_3)_3.9H_2O$. Upon dissolution, 40.0 g DEHP is added rapidly dropwise (3 minutes). The clear solution is stirred 5 minutes then 3.2 g NaF in 32 g $H_2O$ are added dropwise (5 minutes). The white solid is stirred, then diluted with 400 ml $H_2O$, stirred 30 minutes and filtered. A colorless solid results. Elemental analysis is consistent with a 3:1:1 P:Fe:F ratio.

EXAMPLE D

Preparation of $Fe(DEHP)_3$(tetradecylsulfate)

A mixture of 1.06 g tetradecylsulfate in 100 g $H_2O$ with 1.2 g $Fe(NO_3)_3.9H_2O$ yields an orange precipitate which is immediately treated with 3.2 g DEHP and 0.6 g KOH in 50 ml $H_2O$. After stirring 3 days a white solid is filtered and air dried. The infrared spectrum is consistent with the proposed material.

EXAMPLE E

Preparation of $Fe(DEHP)_3$(tetraphenylborate)

To 1.1 g sodium tetraphenylborate and 1.0 g $Fe(NO_3)_3.9H_2O$ in 40 ml H0 is added rapidly 3.2 g DEHP and 0.73 g KOH in 80 ml $H_2O$. The mixture is filtered, dispersed in water, stirred, filtered and air dried. The infrared spectrum is consistent with the proposed material.

EXAMPLE F

Preparation of $Fe(DEHP)_3(Fe(CN)_6)$

This example illustrates that the choice of the counter ion is important in determining the color of the complex. Because it is colored, this complex is not preferred in this invention.

To 25.0 g $H_2O$ is added 0.61 g KOH, 3.2 g DEHP and then 1.2 g $K4(Fe(CN)_6).3H_2O$. A total of 1.2 g $Fe(NO_3)_3.9H_2O$ are added, and the mixture shaken over 6 days. A brown solid results which is filtered and dried. It exhibits an infrared spectrum that shows the presence of the phosphate and the $Fe(CN)_6$ groups.

The following are examples of the preparation of ferric organophosphinates useful in this invention.

EXAMPLE G

Preparation of ferric n-propyl(2-ethylhexyl)phosphinate

To a solution of 25 g of n-propyldichlorophosphineoxide in 300 ml of petroleum ether, 28 g of diethylamine in 150 ml of petroleum ether was added over 4 hours. The petroleum ether was removed by distillation and the remaining n-propyl (diethylamine)chlorophosphine oxide was distilled off under vacuum.

The Grignard of 1-bromo-2-ethylhexane (31 g) was prepared in ether, and 26.4 g of the n-propyl(diethylamine)chlorophosphine oxide was added to it at room temperature and refluxed for 72 hours. The resulting solution was treated with 5M hydrochloric acid and refluxed overnight. On cooling the n-propyl (2-ethylhexyl)phosphinic acid was extracted with petroleum ether and distilled to give a colorless liquid (B.P. = 172°–180° C. at 0.12 mm Hg).

To 1.3 g of $Fe(NO_3)_3.9H_2O$ dissolved in 5 g of glacial acetic acid, 2.7 g of the prepared organophosphinic acid was added. This solution was diluted with 9 parts of water rapidly. The ferric n-propyl(2-ethylhexyl)phosphinate appeared as a white solid precipitate which was filtered off, washed with water, and dried in air.

EXAMPLE H

Preparation of ferric dicyclohexylphosphinate

The dicyclohexylphosphinic acid was made by the method disclosed in Smythe et al., *supra*. A solution of 1.3 g of $Fe(NO_3)_3.9H_2O$ dissolved in 50 ml water was prepared. In a solution of 0.66 g of KOH in 10 g of water, 2.35 g of the phosphinic acid was dissolved. This was diluted with 50 ml water and added rapidly to the solution of ferric nitrate. A fine yellow precipitate occured which was filtered off, washed with water, and air dried to give the ferric dicyclohexylphosphinate.

EXAMPLE I

Preparation of ferric cyclohexyl(2-ethylhexyl)phosphinate

Using the method described in Example G, 30 g of cyclohexyldichlorophosphine oxide was used in place of the n-propyl dichlorophosphine oxide to give a thick colorless oil The white ferric cyclohexyl(2-ethylhexyl)phosphinate was obtained by the treatment described in Example H.

The following are examples of thermographic materials according to this invention.

Definition of Terms used in Examples

Bkgd - total optical reflectance density of the unimaged sheet using a MacBeth RD504 or MacBeth TR924 densitometers.

I.D. - Maximum optical reflection density of the image areas.

This is color of the background. Measured with Hunter Labscan II using 2 degree Observer for Illuminant C and specified in "L-a-b" units.

L,a,b - the luminance and the two color coordinates for the measured surface color using the "L-a-b" color solid.

PCR - Print contrast ratio at wavelength of 900 nm where $$PCR = \frac{R(Bkgd) - R(I.D.)}{R(Bkgd)}$$

and R are the reflectance values equivalent to the indicated measured densities measured with MacBeth PCM-II Print/contrast meter or RJS Enterprises Codascan 3600.

Initiation Temperature is temperature at which an optical density of 0.05 above the background is reached.

EXAMPLE 1—Green Image

A dispersion of the iron tris(di-2-ethylhexyl)phosphate (I) was formed by ball milling for 24 hours 25 grams of (I) in 75 g of acetone using flint glass marbles. To 4.0 g of this dispersion was added 3.27 g of 15% ethylacrylate methyl methacrylate copolymer resin in acetone and 0.5 g of the 1,1'-spirobi[-1H-indene]-5,5'-6,6-tetrol-2,2'3,3,'-tetrahydro-3.3.3'3,'-tetramethyl(II). This was agitated till (II) dissolved. This was coated on 2 mil opaque titanium dioxide filled polyester at 2.5 mil oriface using a knife coater and allowed to air dry. The resulting thermal recording sheet exhibited excellent whiteness giving a blue image which changed to green within four hours.

Bkgd=0.09 I.D.=0.84 initiation temperature=129° C. Initial PCR=0.45; PCR after 12 hours=0.76; Color with Hunter 2C, L=92.37, a=−2.07, b=3.56.

EXAMPLE 2—Purple Image

Same as Example 1 using tannic acid (MCB reagent) in place of (II). This gave a thermal recording sheet with a white background and a purple image which was stable and did not change color.

Bkgd=0.12; I.D.=1.09; Initiation temp.=120° C.; PCR=0.19 measured 12 hours after imaging. Color wih Hunter 2 C, L=89.84, a=−1.19, b=5.06.

EXAMPLE 3—Black Image

A thermal recording sheet was prepared as in Example 1 substituting 0.4 g of (II) and 0.1 g of tannic acid for (II). The thermal recording sheet exhibited a white background with a bluish-purple image which turned black within 4 hours.

Bkdg=0.11; I.D.=1.13; Initiation temp=122° C.; PCR=0.45 increasing to 0.58 within 12 hours. Color with Hunter 2 C, L=91.09, a=−1.60, b=3.56.

EXAMPLE 4—Peroxide Green Image

A thermographic recording sheet was prepared following Example 1 but with the addition of 0.08 g of t-buty(peroxy-benzoate (Aldrich Chem) and immediately coated. The resulting sheet had a light green background with an immediate vibrant green image upon imaging.

Bkgd=0.12; I.D.=1.02; PCR=0.87; Color with Hunter 2 C, L=83.97, a=−7.08, b=8.50.

EXAMPLE 5—Peroxide Black Image

Same as Example 3 but with 0.08 g of t-butylperoxybenzoate and coating immediately. The resulting thermal recording sheet had a very light green background which gave an immediate black image color.

Bkgd=0.12; I.D.=1.24; PCR=0.73; Color with Hunter 2C, L=84.43, a=−5.05, b=5.74.

EXAMPLE 6 —Phenidone

A thermal recording sheet was prepared as in Example 1 with the addition of 0.5 g of a 5% solution in acetone of phenidone A (1-phenyl-3-pyrazolidinone, 95% Aldrich) onto the formulation. This gave excellent pot life eliminating any premature reaction and also gave improved sheet stability. This noticeably whiter thermal recording sheet had the following properties.

Bkgd=0.11; I.D.=0.71; Initiation temp.=131° C.; Initial PCR=0.50 increasing to 0.70 within 12 hours. Color Hunter 2 C; L=92.79, a=−1.48, b=3.83; Side by side control with this example showed Bkgd=0.12; ID=0.84.

EXAMPLE 7—Paper

Same as Example 5 but coated on a 46 lb paper (24×36×500 basis) giving a sheet with good whiteness.

Bkdg=0.09; ID=0.72; Initiation temperature=125.2° C., Color with Hunter 2C, L=91.03, a=−1.28, b=−5.31.

EXAMPLE 8—Acetate

A dispersion of 25 g iron tris(di-2-ethylhexyl) phosphate Acetate was made with 48.75 g Acetone and 1.25 g cellulose acetate by ball milling with flint glass balls for 24 hours. A coating dispersion was prepared from 6.0 g of this dispersion, 5 g of a 12% solution of cellulose acetate in acetone, and 9.0 g of a 10% solution of 1,1',spirobi[-H-indene]-5,5',6,6,-tetol-2,2',3,3'-tetrahydro-3,3,3',3,tetram ethyl(II) in acetone coated at 2 mils wet thickness on 46# (24"×36"×500) paper, and air dried. This thermal recording sheet gave a blue image changing to green within 4 hours.

Bkg=0.16, ID=0.52, initiation temp. of 152° C.

I claim:

1. A colorless thermographic material comprising a transparent film-forming binder, an organic solvent soluble colorless catechol in solid solution in said binder, and colorless or substantially colorless microparticles of a ferric iron compound selected from ferric organophosphates, ferric organophosphinates, and ferric organophosphonates dispersed in said binder, said catechol being in intimate contact with said iron compound, being non-reactive with said iron compound at room temperature, and being reactive with said iron compound at temperatures above 60° C.

2. A colorless thermographic material as recited in claim 1 wherein said colorless catechol is selected from

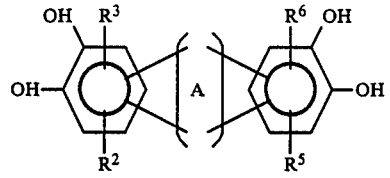

where A is a saturated ring system optionally containing hetero atoms selected from N, O, and S, $R^2$, $R^3$, $R^5$, $R^6$ are independently chosen from H, and electron donating, and electron withdrawing groups consisting of H and no more than 5 atoms chosen from C, N, O, and S,

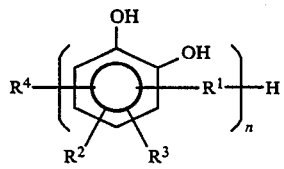

where $R^2$, $R^3$ are defined above, $R^4$ is a capping group chosen from H and alkyl ($C_1$–$C_8$), $R^1$ is a bivalent linking group having saturated bonds at either end selected from alkylene, a chain containing at least one of N, S, O, phenylene, and naphthylene having no more than 12 carbon and hetero atoms, said linking group $R^1$ being chosen such that it does not facilitate electronic interaction between the catechol moieties nor produce with the two catechol hydroxy groups a polydentate chelate,

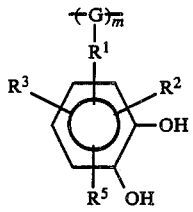

(c)

where $R^2$, $R^3$ and $R^5$ are defined above

G is a unit from a polymer chain chosen from hydrocarbons, alkyd, acryloid, polyester, and phenol formaldehyde resins which are miscible with said binder, $R^1$ is as defined above or if G does not facilitate electronic interaction between catechol moieties, then $R^1$ need not be restricted in this way and in addition to the definition above may be chosen from a single bond and the groups defined for $R^2$, $R^3$ and $R^5$ above, and m is an integer greater than 2; and

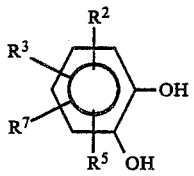

(d)

where $R^2$, $R^3$, $R^5$, are defined above and $R^7$ is an alkyl chain of eight or more carbon atoms

3. A colorless thermographic material according to claim 2 wherein the substituents $R^1$, $R^2$, $R^3$, $R^4$, $R^5$ and $R^6$ are chosen to produce an overall electron donating effect thereby giving enhanced near infrared absorption properties to a thermally produced image.

4. A thermographic sheet comprising a substrate on at least one surface of which is coated a layer of thermographic material according to claim 3.

5. A colorless thermographic material according to claim 2 wherein the substituents $R^1$, $R^2$, $R^3$, $R^4$, $R^5$ and $R^6$ are chosen so that with some of the catechol moieties said substitutents provide electron withdrawing properties and with the remaining catechol moieties said substitutents provide electron donating properties thereby providing in a thermally produced image a visual black color together with enhanced near infrared absorption properties.

6. A thermographic sheet comprising a substrate on at least one surface of which is coated a layer of thermographic material according to claim 5.

7. A thermographic sheet comprising a substrate on at least one surface of which is coated a layer of thermographic material according to claim 1.

8. A colorless thermographic material according to claim 1 wherein said ferric iron compound is selected from (a) $Fe\ [OOP(OR)_2]_3$ (b) $Fe\ [OOP(OR\ ]_3.\ X$ (c) $Fe\ [OOPR(OR)]_3$, and (d) $Fe\ [OOPR_2]_3$ where each R is independently selected from alkyl groups substituted with substituents selected from alkyl, cycloalkyl, and aryl groups, providing that said substituents do not act as ligands or chelates for ferric ions.

9. A thermographic sheet comprising a substrate on at least one surface of which is coated a layer of thermographic material according to claim 8.

10. A colorless thermographic material according to claim 1 wherein said ferric organophosphate is selected from (a) $Fe\ [OOP(OR)_2]_3$ and (b) $Fe[OOP(OR)_2]_3.X$ where each R is selected independently from the group represented by the formula $$-(CH_2)_a-\underset{}{\overset{(CH_2)_c-H}{\overset{|}{CH}}}-(CH_2)_b-H$$

where $1<=c<=10$ $b>a$, $b>c$, and $3<=a+b<=18$ and X is selected from fluoride, hexafluorophosphate, tetraphenylborate, tetrafluoroborate, tetradecylsulfate, acetate, and propionate.

11. A thermographic sheet comprising a substrate on at least one surface of which is coated a layer of thermographic material according to claim 10.

12. A thermographic sheet comprising a substrate on at least one surface of which is coated a layer of thermographic material according to claim 1.

13. A thermographic sheet according to claim 12 in which said colorless catechol is a polycatechol.

14. A thermographic sheet material according to claim 13 in which said polycatechol has the general formula

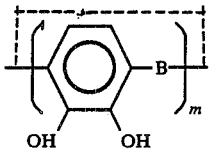

in which B comprises the atoms in an organic bridging group necessary to complete a cyclic structure with the included catechol group and m is an integer from 1 to 10.

15. A thermographic sheet according to claim 14 in which B has the formula $$-\overset{O}{\overset{\|}{C}}-\overset{H}{\overset{|}{N}}-(CH_2)_n-\overset{H}{\overset{|}{N}}-\overset{O}{\overset{\|}{C}}-$$

wherein n is an integer from 1 to 4 and m is an integer of from 1 to 4.

16. A colorless thermographic material according to claim 1 in which said colorless catechol is a polycatechol.

17. A colorless thermographic sheet material according to claim 16 in which said polycatechol has the general formula

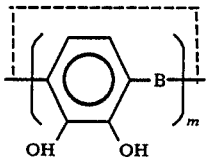

in which B comprises the atoms in an organic bridging group necessary to complete a cyclic structure with the included catechol group and m is an integer from 1 to 10.

18. A sheet material according to claim 17 in which B has backbone atoms selected from the group consisting of C and N.

19. A sheet material according to claim 17 in which B has the formula

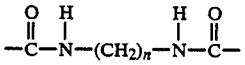

wherein n is an integer from 1 to 4 and m is an integer of from 1 to 4.

20. A sheet material according to claim 19 in which n is 1 and m is 1 to 4.

* * * * *